US006666216B2

(12) United States Patent
Bourjal

(10) Patent No.: US 6,666,216 B2
(45) Date of Patent: Dec. 23, 2003

(54) DEVICE FOR APPLYING A PRODUCT TO A SURFACE

(75) Inventor: Laure Bourjal, Paris (FR)

(73) Assignee: L'Oreal S.A., Paris (FR)

( * ) Notice: Subject to any disclaimer, the term of this patent is extended or adjusted under 35 U.S.C. 154(b) by 9 days.

(21) Appl. No.: 09/910,077

(22) Filed: Jul. 23, 2001

(65) Prior Publication Data

US 2002/0026949 A1 Mar. 7, 2002

Related U.S. Application Data

(60) Provisional application No. 60/304,046, filed on Jul. 11, 2001.

(30) Foreign Application Priority Data

Jul. 24, 2000 (FR) ..... 00 09679

(51) Int. Cl.[7] ..... A45D 40/26
(52) U.S. Cl. ..... 132/320
(58) Field of Search ..... 132/320, 108, 132/110, 112, 114; 401/134, 132, 133, 28, 135, 183; 601/128, 129, 130

(56) References Cited

U.S. PATENT DOCUMENTS

| | | | | | |
|---|---|---|---|---|---|
| 1,059,282 | A | * | 4/1913 | De Bassini | 132/110 |
| 1,429,635 | A | * | 9/1922 | Ross | 132/114 |
| 1,777,736 | A | * | 10/1930 | Salz | 401/134 |
| 2,061,059 | A | * | 11/1936 | Carlson | 410/134 |
| 2,240,604 | A | * | 5/1941 | Berger | 401/134 |
| 2,448,846 | A | | 9/1948 | Trochim | |
| 2,609,821 | A | * | 9/1952 | Weissberger | 132/110 |
| 2,637,466 | A | * | 5/1953 | Wright | 401/134 |
| 2,802,448 | A | * | 8/1957 | Young | 401/134 |
| 3,061,868 | A | * | 11/1962 | Miller | 401/134 |
| 3,081,769 | A | * | 3/1963 | Ackerman | 132/112 |
| 3,466,131 | A | | 9/1969 | Arcudi | |
| 4,415,288 | A | * | 11/1983 | Gorden et al. | 401/132 |
| 4,485,807 | A | | 12/1984 | Guerét | |
| 4,659,243 | A | * | 4/1987 | Winson | 401/134 |
| 4,690,304 | A | * | 9/1987 | Morel | 401/28 |
| 4,811,726 | A | * | 3/1989 | Goncalves et al. | 601/128 |
| 4,898,293 | A | | 2/1990 | Morel | |
| 5,042,690 | A | | 8/1991 | O'Meara | |
| 5,337,764 | A | * | 8/1994 | McKay | 132/114 |
| 6,238,120 | B1 | * | 5/2001 | Mark | 410/134 |

FOREIGN PATENT DOCUMENTS

| | | |
|---|---|---|
| EP | 0 282 338 | 9/1988 |
| FR | 1 477 781 | 4/1967 |
| FR | 2 506 579 | 12/1982 |
| FR | 2 595 587 | 9/1987 |
| FR | 2 659 298 | 9/1991 |
| FR | 2 674 183 | 9/1992 |

OTHER PUBLICATIONS

English language Derwent Abstract of FR 2 595 587, Sep. 18, 1987.

English language Derwent Abstract of FR 2 659 298, Sep. 13, 1991.

English language Derwent Abstract of FR 2 674 183, Sep. 25, 1992.

* cited by examiner

*Primary Examiner*—Todd E. Manahan
(74) *Attorney, Agent, or Firm*—Finnegan, Henderson, Farabow, Garrett & Dunner, L.L.P.

(57) ABSTRACT

A device for applying a product to a surface is provided. The device comprises an applicator member defining an applicator surface and a support coupled to the applicator member. The support defines a first attachment member and at least one opening member. The device further comprises a container containing the product, the container defining an orifice, and a sealing element configured to seal the orifice. The device also comprises a base defining a second attachment member configured to engage the first attachment member. The base is configured to receive the container. The at least one opening member engages the sealing element and at least partially opens the orifice when the second attachment member engages the first attachment member.

72 Claims, 3 Drawing Sheets

DEVICE FOR APPLYING A PRODUCT TO A SURFACE

This application claims the benefit of a U.S. provisional application No. 60/304,046, filed Jul. 11, 2001, entitled: Device for Applying a Product Such as a Cosmetic or Care Product, which is incorporated herein by reference.

The present invention relates to a device for applying a product to a surface. In particular, the present invention relates to a device for applying a cosmetic or care product contained within a sealed container to the skin or into the hair.

A device according to the present invention may be particularly suited to applying and massaging a thinning product or toning product to the stomach, the bust, or the thighs. Thinning and toning products are marketed on a wide scale via various distribution circuits. These products may, for example, be based on ivy, ruscus, arnica, silicon, caffeine or extracts of algae.

Thinning creams have been proliferating for a few years. The action of thinning creams relates, for example, to improving the quality of the skin (orange peel effect, cellulite, firmness, etc). The method of application, which includes massaging by hand the parts of the body that are to be treated, plays a very important role in the process.

Thinning cures have also developed. The doses used in a thinning cure are typically packed in boxes of 10 to 20 one-shot dosing containers, made of polyethylene, with a break-off tip. Such dosing containers are manufactured using the form fill seal (FFS) principle. For use in the morning and at night, the lotion is applied by hand, massaging the zone that is to be treated. However, these lotions are typically very fluid. Thus, commonly some of the product is lost during application. In addition, if the content of a dose is poured out in several stages, there is a high risk that product will be wasted because the dosing container containing the remainder of the product is not very stable.

One known applicator system includes a flexible-walled container, a rim of which delimits an opening. The rim surrounding the opening supports an applicator pad, in particular made of a cellular or spongy thermoplastic resin. The pad is separated from the container by a diaphragm pierced with one or more orifices restricting the flow or, alternatively, by a diaphragm which can be pierced or broken prior to use. Prior to using the applicator, the user drives a pin or some other pointed instrument into the cellular pad and the diaphragm. The pin pierces the diaphragm, creating a hole which provides communication between the container and the pad.

The disadvantages of such a structure are many. The process aimed at establishing communication between the container and the applicator pad is painstaking; good distribution of the product over the entire application area entails the presence of several holes; and there is a non-negligible risk that the pin will accidentally be pushed through the container and also pierce an external wall thereof. Furthermore, the applicator pad is inseparably associated with each dose, which increases costs, particularly manufacturing costs, which are relatively high.

Another known applicator includes a porous pad welded under a thermoplastic housing. The housing contains a capsule, in the form of a bead, in which the product to be applied is located. By compressing the housing, the capsule bursts and the product spreads out over the applicator. The housing acts as a grip. Ducts arranged in a star-shaped configuration allow the product to spread out uniformly on the pad.

Similar to the aforementioned applicator, the drawbacks of this device are many. One dose of product is inseparably associated with one applicator. The product is encapsulated in a bead whose volume is necessarily very limited. The encapsulation process and, more generally, the process involved in manufacturing such a device can be expensive. The effort needed to burst the capsule may be relatively great.

Another known applicator device includes a reservoir containing a product to be applied, the contents of which are isolated from the atmosphere prior to first use by means of a thin film that can be perforated. The reservoir, made of a flexible material, also forms a grip for grasping the device. The film closing off the reservoir prior to first use is pierced using a mobile trocar. Movement of the trocar towards the thin film that is to be perforated is brought about by pressure exerted on the application surface for mounting the reservoir. This device is relatively complicated and uneconomical to produce. Moreover, there is a risk that the user's fingers will be soiled by pressing on the applicator surface when attempting to perforate the membrane. Furthermore, this device is not meant to be refillable.

Another known applicator device includes an applicator mounted on a cylindrical support. The cylindrical support has a ring that forms an interference snap-fit with a complementary groove provided on a tube-like container, or vice versa. The presence of the snap-fit fastener on the container increases the cost thereof and makes it unduly complicated to manufacture. Furthermore, the mounting of the container on the support is not reversible, which means the unit has to be thrown away once its contents have been used up.

Alternatively, if the mounting of the container on the support was to be reversible and if the applicator device was to provide a refillable structure, the presence of the snap-fit fastener on the container could significantly increase costs, because then the container would be a consumable item, e.g., an item that is replaced when its contents have been used up.

Hence, one of the optional aspects of the invention relates to a device for applying a liquid product, for example to the skin or to the hair, and which may be both economical to produce and simple and comfortable to use.

Another optional aspect of the invention relates to an applicator device which may be refillable.

A further optional aspect of the invention relates to an applicator device for the skin, which may be both gentle in its contact with the skin and firm in this contact. Even other optional aspects of the invention relate to an applicator device wherein the contact of the applicator device with the skin may encourage the product to penetrate the skin, encourage circulation under the skin, and tone the skin.

A further optional aspect of the invention relates to a refillable applicator device which may be capable of containing the product to be applied in the form of removable single dose containers. Optionally, the removable container may be equipped with a sealing element isolating the product from the outside prior to first use, which sealing element can be unsealed simply, reliably, cleanly and quickly.

It should be understood that the invention could still be practiced without performing one or more of the optional aspects described above. Still other optional aspects will become apparent from the detailed description that follows.

As broadly described herein, the present invention relates to a device for applying a product to a surface. The device may comprise an applicator member defining an applicator surface and a support coupled to the applicator member. The support may define a first attachment member and at least one opening member. The device may further comprise a container containing the product, the container defining an orifice, and a sealing element configured to seal the orifice. The device may also comprise a base defining a second attachment member configured to engage the first attachment member. The base may be configured to receive the container. The at least one opening member may engage the sealing element and at least partially open the orifice when the second attachment member engages the first attachment member.

In one optional embodiment, the container may be reversibly mounted to the support, so that the container may be replaced after its contents have been used up.

Alternatively, the at least one passage may be created "artificially" in the applicator member. Such artificial passages are not due to the natural properties of the material of the applicator member. These passages may be created, for example, by drilling or, if appropriate, during the molding of the applicator member. Such passages may pass through the entire thickness of the applicator member, for instance, in an axially straight line or in a curved line. Alternatively, in the case of a porous material, for instance, a felt material, a frit or sintered material, or an open-cell or semi-open-cell foam, the passages may include natural passages passing through the applicator member. The term "natural passages" means passages formed as a consequence of the base properties of the porous material. These natural passages may, at least in part, define the porosity or permeability of the material of the applicator member. As another alternative, a combination of the two types of passage may be used.

As another option, the container may be configured to contain a single dose. The term "dose" is used to denote a relatively small volume of product. In general, a dose may contain the amount of product needed for one application, whether to a single part of the body or to several parts of the body. Typically, such a volume may be of the order of a few milliliters.

Thus, the same applicator device may be used to apply multiple doses corresponding to any cure or even to several different cures. Moreover, the opening of the single dose container may be unsealed automatically, with no special handling other than that needed to mount the container to the applicator member. The number of parts may be small. As a result of this, the device may be economical to produce, reliable and simple to use.

In one optional embodiment, the sealing element that closes off the container may include a film, which can be perforated by the opening member. Such a film may, for instance, be bonded or heat sealed to the edges of the opening of the container.

According to another optional embodiment, the device may include a rigid or substantially rigid element for grasping. The phrase "substantially rigid" refers to a level of rigidity that does not result in any noticeable deformation in response to a pressure exerted by the applicator member on the surface to be treated that enables a correct application of the product. A substantially rigid grasping element may enable the applicator device to provide a sufficient firmness of application of the product, for instance, the firmness desired to massage thinning products into the skin.

According to yet another optional embodiment, the container may be held to the applicator device via a mounting member or base, which may be distinct from the container. Optionally, for instance, the base may be relatively rigid, while the separately manufactured container may be relatively flexible. Thus, competing design criteria, such as: (i) having sufficient rigidity for grasping the applicator device and for firmly engaging the container to the device; and (ii) having a flexible container that could result from certain manufacturing processes, for instance, thermoforming, and that could allow compression of the container walls in order to encourage the product to leave the container, may be easily satisfied.

Optionally, the at least one opening member may include at least one trocar formed by the support and capable of engaging a sealing element, which seals the container. The opening member may unseal the container by perforating, tearing, peeling or other opening of the sealing element. In one optional embodiment, the opening members may be arranged adjacent the area where the sealing element is fastened to the container. This may encourage the perforation of the sealing element. For example, if the container has an orifice with a circular cross section, the opening members may be arranged uniformly on the support so as to engage the sealing element at multiple points near the peripheral sealed edge of the sealing element.

According to another optional embodiment, the at least one opening member also may provide flow communication between the container and the applicator member. For this purpose, the opening member may form a trocar having a free end cut at a chamfer or a tubular duct. The trocar and/or the tubular duct may communicate, on the one hand, with the container and, on the other hand, with the at least one passage.

According to one optional embodiment, the tubular duct may project from a surface of the support. The duct may have at least one channel or slot passing through the duct and extending over all or part of the height of the duct. This channel or slot may optimize the degree to which the container can be emptied. By way of example, the wall of the duct may have a slot extending axially from the surface of the support, from which the duct projects, as far as the angled free edge, into which the slot may open. Alternatively, a slot may extend over only part of the height of the duct, so as not to appreciably affect the rigidity of the opening member.

Alternatively, a plurality of projecting ducts or trocars may be arranged near the peripheral edge of the support. Furthermore, at its centre the support may have, passing through it, an orifice or duct which opens onto the container side in the plane of the support, without being associated with a projecting duct or trocar.

The applicator member optionally has a plurality of feed passages passing through it. These passages may be arranged to enable almost all of the applicator surface area to be fed with the product. The passages also may be arranged to line up with, or be offset from, each of the ducts or trocars of the support. Other means of distributing the product over substantially the entire applicator area may be provided. For example, star-shaped ducts fed from a central point may be provided.

The applicator member may be formed from a frit or a sintered material. The sintered material may be formed from, for example, a thermoplastic, a felt, or an elastically compressible material such as an open-cell or closed-cell foam. According to one optional embodiment, the applicator member may be made of a thermally compressed foam. One example of such a thermally compressed foam, together with the method for obtaining it, are described in FR-A 2 674 183.

The surface of the applicator member may be covered with a product-permeable sheet or film. For example, the surface may be formed from a woven sheet, a non-woven sheet of material, such as lycra®, polyamide, polyurethane, polyvinyl chloride, plush loop or velour, or a perforated film.

In the case of an applicator member made of a compressible foam covered with a textile fabric, the foam may provide softness and compressibility. The fabric, for its part, may provide for more pleasant contact between the applicator member and the surface to be treated. The textile fabric may be a single layer or a multi-layer complex. In the case of a highly fluid product, particularly an alcohol-based one, the product may spread by capillary action over the entire surface of the fabric. Moreover, the textile covering may be decorated with a pattern that can be chosen at will. The foam and fabric combination may result in an applicator device that remains free of scratches and is unbreakable and very light weight.

The applicator surface may have a profile forming raised portions or bumps capable of massaging the surface to be treated and of encouraging the product to penetrate into the surface to be treated. The profile of the applicator surface may be chosen according to the part of the body to be treated. For instance, in the case of an applicator member formed of a foam such as described in the aforementioned FR-A 2 674 183, the raised portions form an integral part of the block of foam.

According to another optional embodiment, the container may be made at least partially out of a flexible material. The flexibility of the container may enable a user to encourage the product to leave the container in response to pressure exerted on the walls of the container. A container made at least partially out of a flexible material may be particularly suited to the applying of more viscous liquid products.

The container may comprise a thermoformed container, for example a translucent one. The orifice or opening of the container may be closed off by a membrane in the form of a sheet, for example, an aluminium sheet or a multi-layer sheet, which may comprise at least one metal layer and at least one thermoplastic layer. The multi-layer sheet may be a laminate. By way of example, a thermoformed container may be made of polypropylene, polyvinyl chloride, or acrylonitrile copolymer (BAREX®).

According to yet another optional aspect, the first and second attachment members may collaborate through screwing or through snap-fastening. Screw fastening, aside from the sealing it affords, may make it possible to limit the effort needed to unseal the container.

The second attachment member may be formed on a rigid or substantially rigid mounting member or base. Additionally, the base may form the element by which the device can be grasped. Optionally, the base may form an annular element capable of accommodating the container. Thus, part of the container may emerge through the annular base, such that when the container is made of a flexible material, the emerging portion of the container may be compressed so as to encourage the product to leave.

According to another optional aspect, the invention may relate to a device comprising an applicator member, a support, and a base. The applicator member may define an applicator surface. The support may be coupled to the applicator member. Furthermore, the support may define a first attachment member and at least one opening member. The base may define a second attachment member to engage with the first attachment member. Moreover, the base may be configured to receive a container, and the at least one opening member may be configured to open the container when the second attachment member engages the first attachment member.

According to yet another optional aspect, a system for applying a product to a surface to be treated may be provided. The system may comprise a device having an applicator member, a support, and a base, a container containing the product, and a sealing element. The container may define an orifice and the sealing element may be configured to seal the orifice.

The container may be a single dose container, the product may be chosen from a cosmetic product and a care product, and the product may be chosen from a thinning product and a toning product.

According to another optional aspect, a device for applying a product to a surface may comprise a member defining an applicator surface fed by at least one passage and being mounted on a support comprising a first fixing means. The first fixing means may be configured to collaborate with a second fixing means, so as to enable a container containing the product to be mounted. The second fixing means may be borne by a mounting member distinct from the container. The collaboration between the first and the second fixing means may cause the engagement of an element that closes off an opening delimited by the container with the at least one opening member formed by the support. The collaboration may also cause at least partial uncovering of the opening and the allowance of the product to be fed to the applicator surface via the at least one passage.

According to yet another optional aspect, the invention may relate to a method for applying a product to at least one of a skin and hair. The method may comprise providing a device for applying a product and placing the applicator surface of the device in contact with at least one of skin and hair to apply the product thereto.

The term "providing" is used broadly, and refers to, but is not limited to, making available for use, giving, supplying, obtaining, getting a hold of, acquiring, purchasing, possessing, making ready for use, and/or placing in a position ready for use.

The method may further comprise reversibly engaging the first attachment member with the second attachment member. Optionally, the method may comprise disengaging the first attachment member from the second attachment member and removing the container from the base. Furthermore, the method may comprise at least partially opening the container with the at least one opening member. The method may also comprise passing at least a portion of the product to the applicator surface of the device, and putting the applicator surface in contact with the skin and/or hair. Passing the product to the applicator surface may occur via a plurality of passages defined by the applicator member.

The method may further comprising applying a pressure to the applicator member and massaging the product into the skin and/or hair. The applicator may define raised portions and the placing may comprise putting the raised portions in contact with at least one of the skin and hair.

Besides the structural arrangements and procedural aspects described above, there could include a number of other arrangements, such as those explained hereinafter. It is to be understood that both the foregoing description and the following description are exemplary.

The accompanying drawings are incorporated in and constitute a part of this specification. The drawings illustrate an optional embodiment of the invention. In the drawings.

Reference will now be made in detail to an embodiment of the invention, an example of which is illustrated in the accompanying drawings. Whenever possible, the same reference numbers are used in the drawings and the description to refer to the same or like parts.

Figure 1:
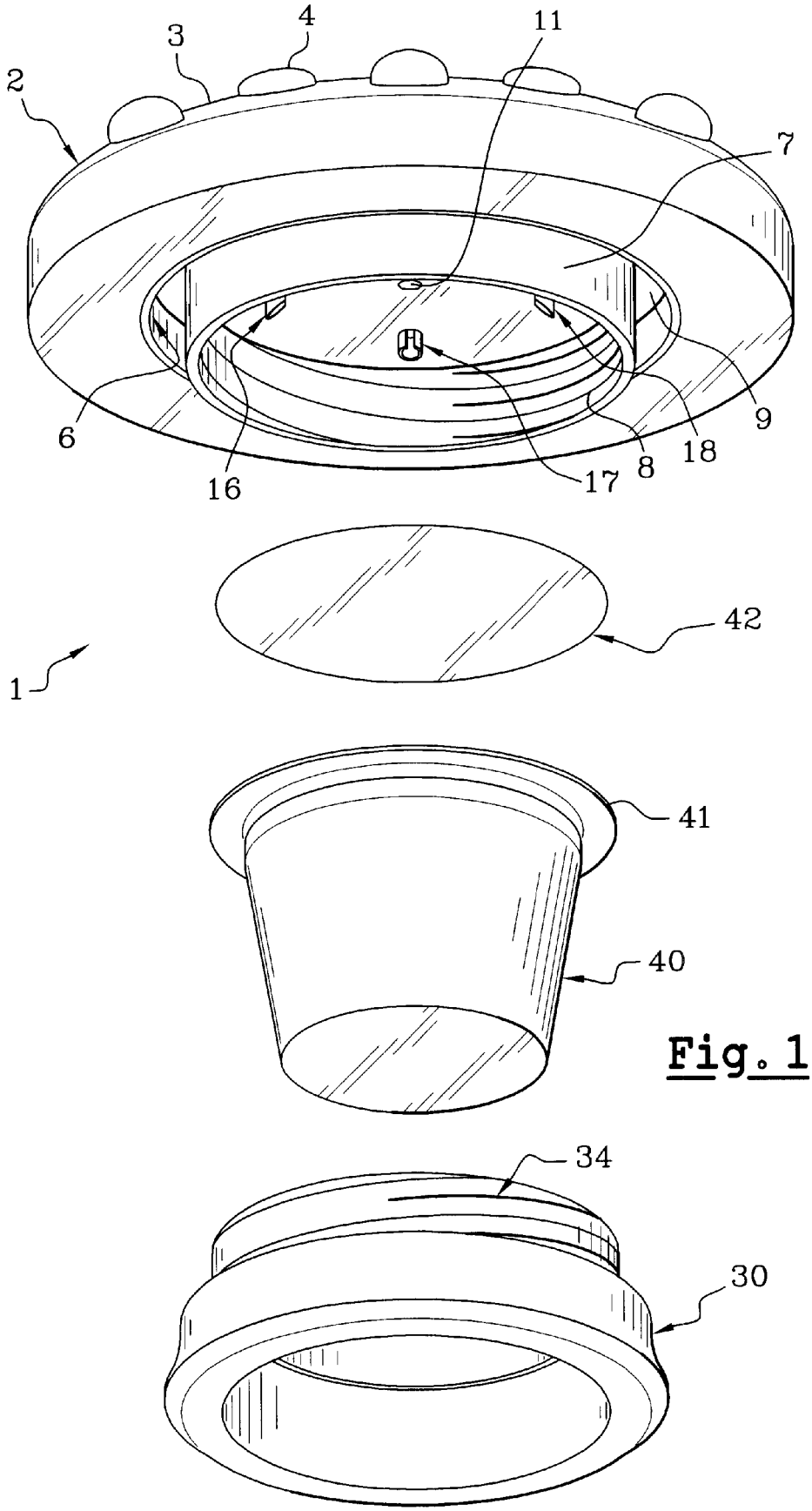
FIG. 1 is an exploded perspective view of an embodiment of a device for applying a product to a surface.
Figure 2:
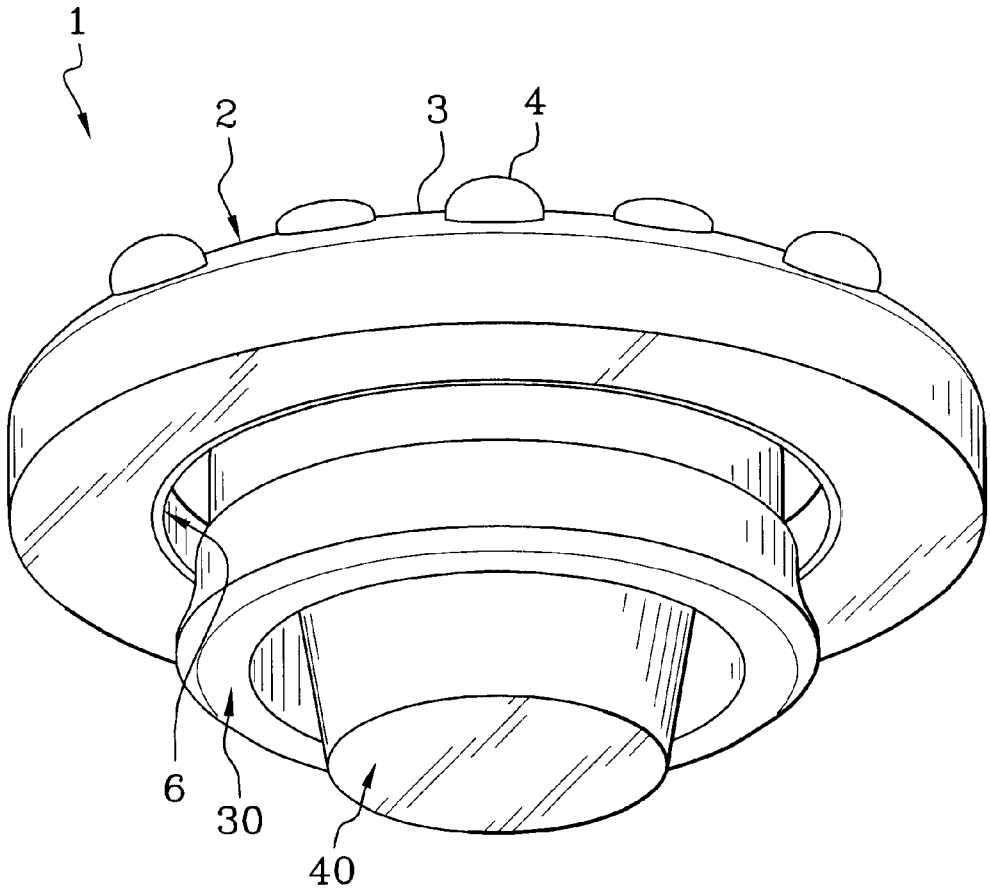
FIG. 2 is a perspective view of the device of FIG. 1, with the container in the mounted position.
Figure 3:
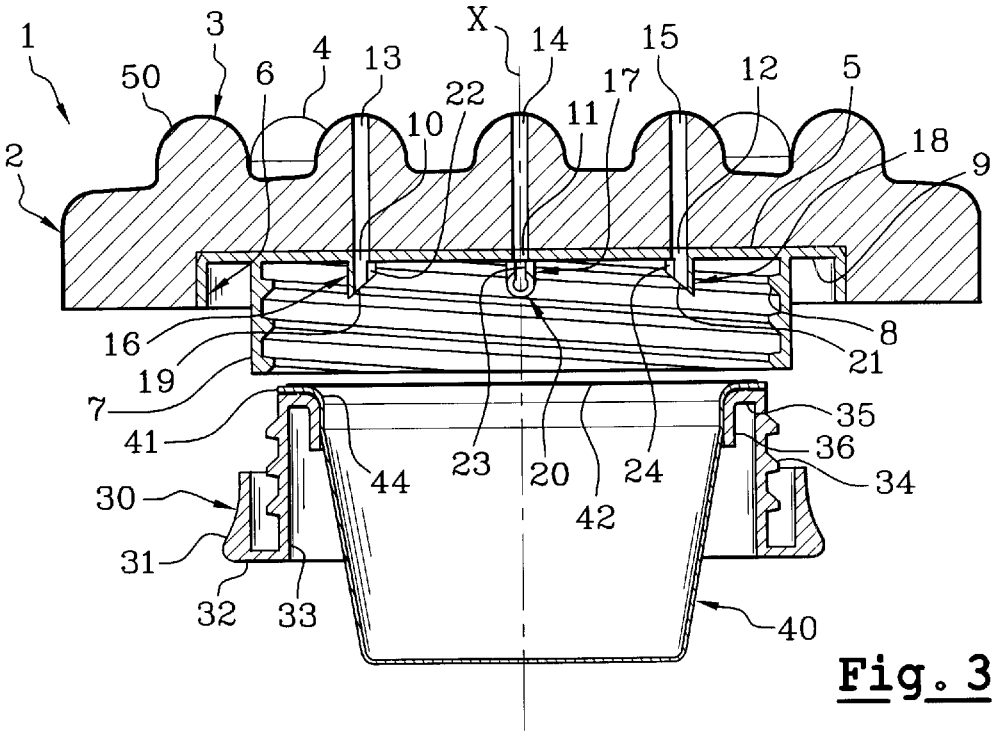
FIGS. 3 and 4 are cross-sections relating to the device of FIGS. 1 and 2.
Figure 4:
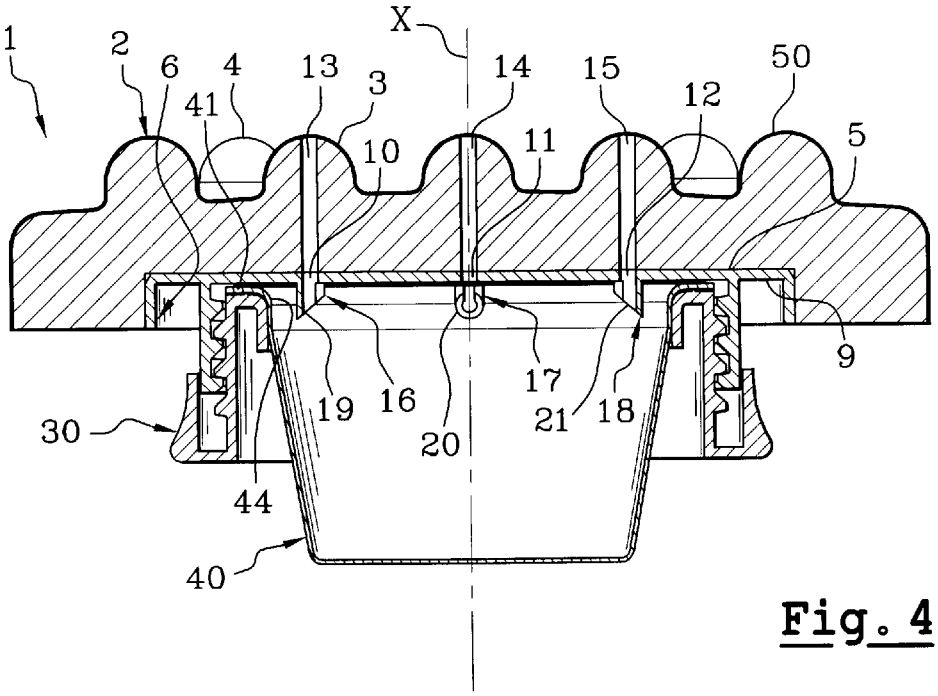

Referring to FIGS. 1 to 4, a device according to an optional embodiment of the invention is depicted. The device 1 comprises an applicator member 2 in the form of a block of thermally compressed foam. One face 3 forms an applicator surface of the device. The face 3 may have raised portions or bumps 4 arranged over the applicator face 3. The bumps 4 may be arranged uniformly over the entire face 3. The applicator member 2 may comprise foam, and may, for instance, be obtained in accordance with the aforementioned FR-A 2 674 183. On the applicator face 3, the applicator member 2 may be covered with a layer of an elastic textile material 50 made of lycra®. The textile layer 50 may be fixed to the foam by flame brushing or using a hot melt adhesive. A face 5 of the applicator member 2, as shown in FIGS. 3 and 4, opposite the face 3, may be welded or bonded to a polypropylene support 6. The support 6 may comprise a skirt 7 whose interior surface has a screw thread or attachment member 8. One end of the skirt 7 may be closed by a transverse wall 9 against which the face 5 of the applicator member 2 may rest.

The transverse wall 9 may have a plurality of passages 10, 11, 12 passing through it. One end of each of the plurality of passages 10, 11, 12 may open into opposing passages 13, 14, 15, which may pass through the entire thickness of the applicator member 2 and extend as far as the textile layer 50. The other end of the passages 10, 11, 12 may open into the skirt 7 of the support 6 via tubular ducts 16, 17, 18. The tubular ducts 16, 17, 18 may each have a free end 19, 20, 21, situated some distance from the transverse wall 9, which is cut at an angle or chamfered. The ducts 16, 17, 18 may be provided with a slot 22, 23, 24 extending axially from the interior face of the transverse wall 9 as far as the free edge 19, 20, 21 of the ducts.

In the embodiment illustrated, a passage 11 may be situated at the center of the transverse wall 9. One end of the central passage 11, situated inside the skirt 7, may open more or less into the plane of the interior face of the transverse wall 9. This may facilitate complete emptying of the dose from a thermoformed container or cup 40, when the cup is in the inverted position. The other end of the passage 11 may open opposite the central passage 14 of the applicator member 2. The ducts or trocars 16, 17, 18 and their associated passages 10, 12 may be arranged at 90° from one another all around the central passage 11.

The device of this optional embodiment may also comprise a rigid mounting member 30 in the form of a ring, for instance, a polypropylene ring. The ring 30 may comprise an exterior skirt 31 which has a free end facing towards the support 6. The ring 30, may also be connected via a flange 32 to a skirt 33 whose exterior surface may have a screw thread or attachment member 34 capable of collaborating with the screw thread 8 of the support 6. The end of the skirt 33 remote from the flange 32 may connect, via a flange 35, to a skirt 36 which may extend over about ⅓ of the height of the skirt 33. Skirt 36 may have a free end facing in the opposite direction from the applicator member 2. The thermoformed cup 40 containing the product to be applied may be removably mounted inside the mounting ring 30. The cup 40 may be of frustoconical longitudinal section and may have a rim 41 intended to rest against the flange 35 of the mounting ring 30. The rim 41 may delimit an orifice or opening 44, closed by an inner seal or sealing element 42, which may be heat sealed to the rim 41.

In this embodiment, the device may be mounted as follows. The user takes a cup 40 of product, equipped with its inner seal 42, and places it inside the mounting ring 30 (FIG. 3). She screws the ring 30 onto the support 6. As she does this, the inner seal 42 is brought into engagement with the angled end 19, 20, 21 of the ducts 16, 17, 18, and this engagement causes the inner seal 42 to be perforated. The ducts 16, 17, 18 are thus brought into flow communication with the inside of the cup 40. The screwing movement continues until the rim 41 of the cup 40 comes to bear, in sealed manner, against the interior surface of the transverse wall 9 (FIG. 4). One or more annular bulges (not depicted) may be provided on the flange 35 and/or on the interior face of the transverse wall 9, so as to provide a better seal.

The device 1 may then be inverted so as to feed the product within the cup 40 to the applicator surface 3. The product may be fluid enough to run out towards the applicator surface 3, simply under the effect of its weight, via the ducts 16, 17, 18 and the passages 13, 14, 15 passing through the applicator member 2. The product spreads by capillary action over the entire surface of the textile fabric 50 that forms the applicator surface 3.

Thereafter, the application surface 3 may be brought into contact with the surface to be treated, the device being firmly held by means of the skirt 31 of the mounting ring 30. Penetration of the product into the skin may be encouraged by vigorous massaging of the surfaces to be treated using the device which may be held firmly by the skirt 31 of the mounting ring 30. Because of the flexibility of the material forming the dose holder cup 40, the bottom of the cup can be pressurized with the user's index finger while the ring 30 is held between the thumb and the middle finger, so as to encourage the product to leave in the direction of the applicator face 3.

Once the dose holder cup 40 has been completely emptied, the ring 30 may be unscrewed until it disengages from the support 6. The dose holder cup 40 may then be removed from the ring 30. The device can be rinsed, if the user desires, under the tap to clean it. The device is then ready once again to receive another dose of product for a further application.

It will be apparent to those skilled in the art that various modifications and variations can be made to the structure and methodology described herein. Thus, it should be understood that the invention is not limited to the the examples discussed in the specification. Rather, the present invention is intended to cover modifications and variations.

What is claimed is:

1. A device for applying at least one of a skin cosmetic product and a skin care product to a skin surface, the device comprising:

an applicator member defining an applicator surface;

a support coupled to the applicator member, the support defining a first attachment member and at least one opening member stationary with respect to the applicator member;

a container containing at least one of a skin cosmetic product and a skin care product, the container defining an orifice;

a sealing element configured to seal the orifice; and a base defining a second attachment member configured to engage the first attachment member, wherein the base is configured to receive the container, and wherein the at least one opening member engages the sealing element and at least partially opens the orifice when the second attachment member engages the first attachment member.

2. The device of claim 1, wherein the applicator member defines at least one passage, and wherein the at least partial opening of the orifice enables at least a portion of the product to reach the applicator surface via the at least one passage.

3. The device of claim 1, wherein the first attachment member and the second attachment member reversibly engage to enable removal of the container from the base.

4. The device of claim 1, wherein the container is a single dose container.

5. The device of claim 1, wherein the at least one opening member is configured to perforate the sealing element.

6. The device of claim 5, wherein the sealing element is a heat-sealed film.

7. The device of claim 1, further comprising a substantially rigid handling element.

8. The device of claim 2, wherein the at least one opening member defines a free edge and at least one tubular duct in flow communication with the at least one passage.

9. The device of claim 8, wherein the at least one tubular duct is in flow communication with the container when the opening member at least partially opens the orifice.

10. The device of claim 2, wherein the at least one opening member defines a trocar having a chamfered free edge.

11. The device of claim 2, wherein the applicator member defines a plurality of passages configured to distribute at least a portion of the product to substantially the entire applicator surface.

12. The device of claim 1, wherein the base comprises a substantially rigid handling element.

13. The device of claim 12, wherein the substantially rigid handling element defines an annular element configured to encircle the container.

14. The device of claim 1, wherein the applicator member comprises a sintered material.

15. The device of claim 14, wherein the sintered material comprises one of a thermoplastic material, a felt material, and an elastically compressible material.

16. The device of claim 15, wherein the elastically compressible material is a thermally-compressed foam.

17. The device of claim 14, wherein the applicator surface comprises a material capable of being permeated by the product.

18. The device of claim 17, wherein the material comprises one of a woven sheet and a non-woven sheet.

19. The device of claim 17, wherein the material comprises one of a lycra® material, a polyamide material, a polyurethane material, a polyvinyl chloride material, a plush loop material, a velour material, and a perforated film material.

20. The device of claim 1, wherein the applicator surface defines raised portions.

21. The device of claim 1, wherein the container is formed at least partially of a relatively flexible material.

22. The device of claim 21, wherein pressure exerted on the container encourages at least a portion of the product within the container to leave the container.

23. The device of claim 1, wherein the container comprises a thermoformed container.

24. The device of claim 23, wherein the container is translucent.

25. The device of claim 23, wherein the thermoformed container comprises one of a polypropylene material, a polyvinyl chloride material, and an acrylonitrile copolymer material.

26. The device of claim 1, wherein the sealing element comprises one of a film, a sheet, and a membrane.

27. The device of claim 1, wherein the sealing element comprises one of a sheet of aluminum and a sheet comprised of at least one metal layer and at least one thermoplastic layer.

28. The device of claim 1, wherein the engagement of the first attachment member to the second attachment member comprises one of a screw-fastening engagement and a snap-fastening engagement.

29. A device for applying at least one of a skin cosmetic product and a skin care product to a skin surface, the device comprising:

an applicator member defining an applicator surface and at least one passage;

a support coupled to the applicator member, the support defining a first attachment member and at least one opening member, the at least one opening member defining a free edge and at least one tubular duct in flow communication with the at least one passage, wherein the at least one tubular duct comprises a wall having a slot extending from the free edge along at least a portion of the wall;

a container containing at least one of a skin cosmetic product and a skin care product, the container defining an orifice;

a sealing element configured to seal the orifice; and a base defining a second attachment member configured to engage the first attachment member, wherein the base is configured to receive the container, and wherein the at least one opening member engages the sealing element and at least partially opens the orifice when the second attachment member engages the first attachment member to enable at least a portion of the product to reach the applicator surface via the at least one passage.

30. The device of claim 29, wherein the slot extends axially.

31. A device for applying at least one of a skin cosmetic product and a skin care product to a skin surface, the device comprising:

an applicator member defining an applicator surface;

a support coupled to the applicator member, the support defining a first attachment member and at least one opening member stationary with respect to the applicator member;

a base defining a second attachment member configured to engage with the first attachment member; and a sealed container received by the base and containing at least one of a skin cosmetic product and a skin care product, wherein the at least one opening member is configured to at least partially open the container when the second attachment member engages the first attachment member.

32. The device of claim 31, wherein the applicator member defines at least one passage in flow communication with the applicator surface.

33. The device of claim 31, wherein the first attachment member and the second attachment member reversibly engage.

34. The device of claim 31, further comprising a substantially rigid handling element.

35. The device of claim 32, wherein the at least one opening member defines a free edge and at least one tubular duct in flow communication with the at least one passage.

36. The device of claim 35, wherein the at least one tubular duct is configured to be in flow communication with the container when the opening member opens the container.

37. The device of claim 32, wherein the at least one opening member defines a trocar having a chamfered free edge.

38. The device of claim 35, wherein the at least one tubular duct comprises a wall having a slot extending from the free edge along at least a portion of the wall.

39. The device of claim 38, wherein the slot extends axially.

40. The device of claim 32, wherein the applicator member defines a plurality of passages configured to distribute the product to substantially the entire applicator surface.

41. The device of claim 31, wherein the applicator member comprises a sintered material.

42. The device of claim 41, wherein the sintered material comprises one of a thermoplastic material, a felt material, and an elastically compressible material.

43. The device of claim 42, wherein the elastically compressible material is a thermally-compressed foam.

44. The device of claim 41, wherein the applicator surface comprises a material capable of being permeated by the product.

45. The device of claim 44, wherein the material comprises one of a woven sheet and a non-woven sheet.

46. The device of claim 44, wherein the material comprises one of a lycra® material, a polyamide material, a polyurethane material, a polyvinyl chloride material, a plush loop material, a velour material, and a perforated film material.

47. The device of claim 31, wherein the applicator surface defines raised portions.

48. The device of claim 31, wherein the engagement of the first attachment member to the second attachment member comprises one of a screw-fastening engagement and a snap-fastening engagement.

49. The device of claim 31, wherein the base comprises a substantially rigid handling element.

50. The device of claim 49, wherein the substantially rigid handling element defines an annular element configured to encircle the container.

51. The device of claim 31, wherein to container defines an orifice, and p1 wherein the device further comprises a sealing element configured to seal the orifice.

52. The device of claim 51, wherein the container is a single dose container.

53. The device of claim 51, wherein the at least one opening member is configured to perforate the sealing element, and the sealing element comprises one of a film, a sheet, and a membrane.

54. The device of claim 53, wherein the sealing element is a heat-sealed film.

55. The device of claim 51, wherein the container is formed at least partially of a relatively flexible material.

56. The device of claim 51, wherein the container comprises a thermoformed container.

57. The device of claim 51, wherein the product is a skin cosmetic product.

58. The device of claim 51, wherein the product is chosen from a thinning product and a toning product.

59. A method for applying a product at least one of skin cosmetic product and a skin care product to skin, comprising:

providing the device of claim 51; and placing the applicator surface in contact with the skin to apply the product thereto.

60. The method of claim 59, wherein the product comprises one of a thinning product and a toning product.

61. The method of claim 59, further comprising reversibly engaging the first attachment member with the second attachment member.

62. The method of claim 59, further comprising passing the product from the container to the applicator surface via a plurality of passages defined by the applicator member.

63. The method of claim 59, wherein the applicator surface defines raised portions, and wherein the placing comprises putting the raised portions in contact with the skin.

64. The method of claim 59, further comprising at least partially opening the container with the at least one opening member, and passing at least a portion of the product to the applicator surface.

65. The method of claim 61, further comprising disengaging the first attachment member from the second attachment member and removing the container from the base.

66. The method of claim 64, wherein the passing comprises passing at least a portion of the product through at least one passage defined within the applicator member.

67. The method of claim 64, wherein the opening comprises perforating the sealing element with the at least one opening member.

68. The method of claim 59, further comprising applying pressure to the applicator member and massaging the product onto the skin.

69. A device for applying at least one of a skin cosmetic product and a skin care product to a skin surface, comprising:

a support comprising a first fixing means and at least one opening member;

an applicator member defining an applicator surface fed by at least one passage and being mounted on the support;

a base comprising a second fixing means configured to collaborate with the first fixing means;

a container containing at least one of a skin cosmetic product and a skin care product, the container being mounted on the base, the container defining an orifice; and a sealing element configured to seal the orifice, wherein the collaboration between the first and the second fixing means causes engagement of the sealing element with the at least one opening member, so as to cause at least partial uncovering of the orifice and to allow the product to be fed to the applicator surface via the at least one passage.

70. The device of claim 69, wherein the at least one opening member is stationary with respect to the applicator member.

71. A device for applying at least one of a skin cosmetic product and a skin care product to a skin surface, the device comprising:

an applicator member defining an applicator surface;

a support coupled to the applicator member, the support defining a first attachment member and at least one opening member;

a container containing at least one of a skin cosmetic product and a skin care product, the container defining an orifice;

a sealing element configured to seal the orifice; and a base defining a second attachment member configured to engage the first attachment member, wherein the base is configured to receive the container, and wherein the device is configured so that engagement of the first attachment member with the second attachment member causes movement of the at least one opening member with respect to the sealing element so as to at least partially open the orifice.

72. A device for applying at least one of a skin cosmetic product and a skin care product to a skin surface, the device comprising:

an applicator member defining an applicator surface;

a support coupled to the applicator member, the support defining a first attachment member and at least one opening member;

a base defining a second attachment member configured to engage with the first attachment member; and a sealed container received by the base and containing at least one of a skin cosmetic product and a skin care product.

wherein the device is configured so that engagement of the first attachment member with the second attachment member causes movement of the at least one opening member with respect to the container so as to at least partially open the container.

* * * * *

UNITED STATES PATENT AND TRADEMARK OFFICE

CERTIFICATE OF CORRECTION

PATENT NO. : 6,666,216 B2
DATED : December 23, 2003
INVENTOR(S) : Laure Bourjal

It is certified that error appears in the above-identified patent and that said Letters Patent is hereby corrected as shown below:

Column 11,
Line 43, “to container” should read -- the container --.
Line 44, after “and”, delete “p1” and insert a paragraph break.
Line 62, “applying a product at least one of skin” should read -- applying at least one of a skin --.

Signed and Sealed this

Thirtieth Day of March, 2004

JON W. DUDAS
*Acting Director of the United States Patent and Trademark Office*